US006374830B1

(12) United States Patent
Afeworki

(10) Patent No.: US 6,374,830 B1
(45) Date of Patent: Apr. 23, 2002

(54) HAIR ROLLER WITH ELLIPTICAL CROSS SECTION

(76) Inventor: Azieb Afeworki, 574 3rd St., #234, San Francisco, CA (US) 94107

( * ) Notice: Subject to any disclaimer, the term of this patent is extended or adjusted under 35 U.S.C. 154(b) by 0 days.

(21) Appl. No.: 09/734,990

(22) Filed: Dec. 12, 2000

(51) Int. Cl.[7] ..... A45D 2/08
(52) U.S. Cl. ..... 132/250
(58) Field of Search ..... 132/210, 222, 132/223, 226, 245, 248, 249, 250, 251, 253, 256, 261, 262, 268; D28/35, 37

(56) References Cited

U.S. PATENT DOCUMENTS

| | | | | | |
|---|---|---|---|---|---|
| 952,396 | A | * | 3/1910 | Willman | 132/250 |
| 1,424,654 | A | * | 8/1922 | Kitson | 132/273 |
| 1,495,054 | A | * | 5/1924 | West | 132/250 |
| 2,391,284 | A | * | 12/1945 | Weiss | 132/122 |
| 2,423,252 | A | | 7/1947 | Nemeth | |
| 2,862,508 | A | * | 12/1958 | Campbell | 132/259 |
| 3,712,310 | A | | 1/1973 | Parlagreco | |
| 3,881,500 | A | * | 5/1975 | Shinbashi et al. | 132/252 |
| 4,201,236 | A | | 5/1980 | Morefield | |
| 4,240,451 | A | | 12/1980 | Thompson | |
| 4,515,171 | A | | 5/1985 | Thibodeaux | |
| 4,742,835 | A | * | 5/1988 | Boweter | 132/226 |
| 4,974,613 | A | | 12/1990 | Ho | |
| 4,984,591 | A | * | 1/1991 | Jacobi | 132/229 |
| 4,993,441 | A | | 2/1991 | Hanson | |
| 5,487,396 | A | | 1/1996 | Wilson | |
| 5,551,457 | A | | 9/1996 | Williamson | |
| 5,791,356 | A | | 8/1998 | Muzzipapa | |

FOREIGN PATENT DOCUMENTS

| | | | | |
|---|---|---|---|---|
| AU | 214603 | * | 3/1957 | 132/250 |
| AU | 0224717 | * | 4/1958 | 132/250 |
| CH | 354905 | * | 7/1961 | 132/226 |
| DE | 3302237-a | * | 7/1984 | 132/245 |
| IT | 0556382 | * | 11/1958 | 132/250 |

* cited by examiner

*Primary Examiner*—Eduardo C. Robert
(74) *Attorney, Agent, or Firm*—Jack Lo

(57) ABSTRACT

The present hair roller is comprised of a hollow tube with an elliptical cross section for producing hair curls of a novel shape. A fixed end of an elastic loop is attached to a first end of the tube. After hair is wrapped around the tube, the free end of the loop is stretched around the hair and across a second end of the tube to secure the hair. The opposite ends of the tube have scalloped edges that stabilize the loop in its selected radial position when stretched around the tube. The outside of the tube is textured for providing traction and preventing the hair from slipping. Holes are distributed around the outside of the tube to allow a perm solution to soak through the hair better for a perm, and to enable air circulation for drying the hair faster for a wet set.

7 Claims, 1 Drawing Sheet

HAIR ROLLER WITH ELLIPTICAL CROSS SECTION

BACKGROUND OF THE INVENTION

1. Field of the Invention

This invention relates generally to hair rollers.

2. Prior Art

A typical hair roller is comprised of a small tube, and an elastic cord attached to one end of the tube. After hair is wrapped around the roller, it is secured on the head by connecting the elastic cord to the other end of the tube. Perm solution is applied to the hair to create curls.

Most prior art rollers have a single elastic cord with a fixed end attached to one end of the tube, and a free end connectable to the other end of the tube. Examples of such rollers are disclosed in U.S. Pat. No. 3,712,310 to Parlagreco; U.S. Pat. No. 4,240,451 to Thompson; and U.S. Pat. No. 4,515,171 to Thibodeaux. The hair is secured to only one side of the tube by the single elastic cord, so that the hair can loosen. Although a roller with an elastic loop is disclosed in U.S. Pat. No. 2,423,252 to Nemeth, the fixed end of the loop is not centered on the axis of the tube, so that it can only be positioned on one side of the tube.

Almost all prior art hair rollers have perfectly circular cross sections that produce curls of the same shape. An exception is a hair roller disclosed in U.S. Pat. No. 4,974,613 to Ho. It has a generally oval cross section, as shown in FIG. 8 of the patent to Ho. The cross section is comprised of two straight portions on the long sides connected to two straight portions on the short sides by curved portions. There are sharp corners at the junctions between the curved portions and the straight portions, particularly on the short sides. The straight portions and sharp corners produce curls with straight sections and sharp kinks that are unattractive. Further, the hair is retained by a single rigid clip on a short side of the roller, so that the hair can also loosen. The point where the hair is secured to the roller is limited by the position of the clip to the short side, so that the curls will always turn out in the same shape, and no variations are possible.

OBJECTIVES OF THE INVENTION

Accordingly, the objectives of the present hair roller are:

to produce hair curls of a novel shape;

to prevent the hair from loosening when wrapped around the roller;

to be able to make curls of different shapes by altering the attachment point of the hair on the roller;

to prevent the hair from slipping off;

to help perm solution to soak into the hair for a perm;

to speed up drying of the hair for a wet set; and to be very simple in construction.

Further objectives of the present invention will become apparent from a consideration of the drawings and ensuing description.

BRIEF SUMMARY OF THE INVENTION

The present hair roller is comprised of a hollow tube with an elliptical cross section for producing hair curls of a novel shape. A fixed end of an elastic loop is attached to a first end of the tube. After hair is wrapped around the tube, the free end of the loop is stretched around the hair and across a second end of the tube to secure the hair. The opposite ends of the tube have scalloped edges that stabilize the loop in its selected radial position when stretched around the tube. The outside of the tube is textured for providing traction and preventing the hair from slipping. Holes are distributed around the outside of the tube to allow a perm solution to soak through the hair better for a perm, and to enable air circulation for drying the hair faster for a wet set.

DRAWING REFERENCE NUMERALS

| | |
|---|---|
| 10. Tube | 11. Fixed End |
| 12. Elastic Loop | 13. Anchor Member |
| 14. First End | 15. Handle |
| 16. Free End | 17. Hole |
| 18. Texture | 19. Holes |
| 20. Second End | 21. Scalloped Edge |
| 22. Scalloped Edge | |

DETAILED DESCRIPTION OF THE INVENTION

Figure 1:
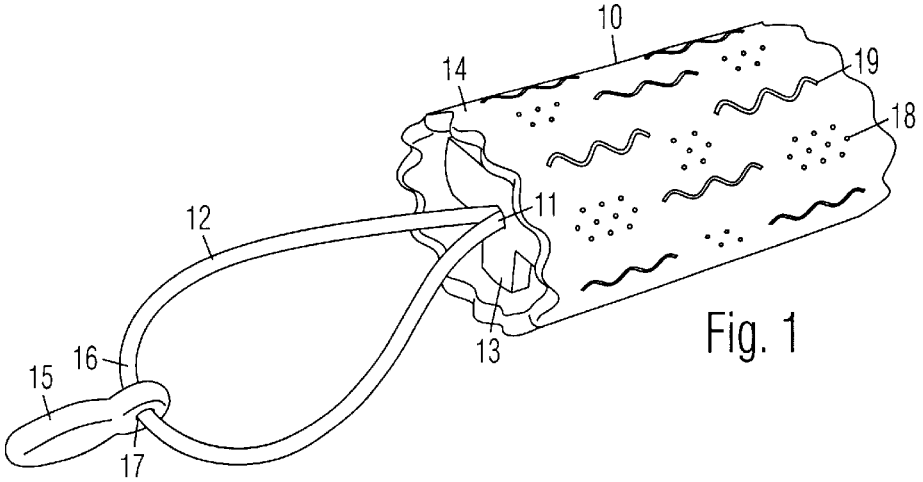
FIG. 1 is a side perspective view of the present hair roller.
Figure 2:
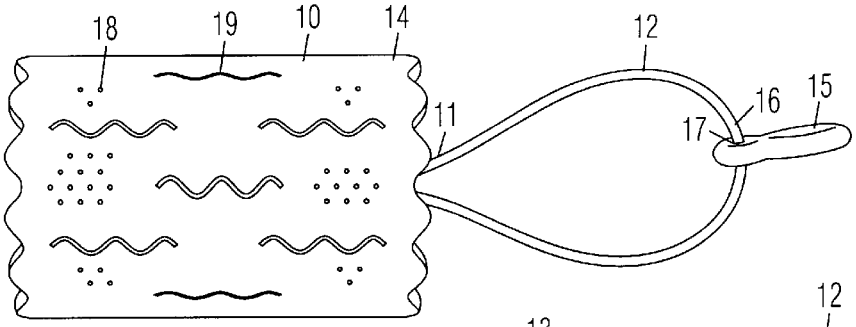
FIG. 2 is a side view thereof
Figure 3:
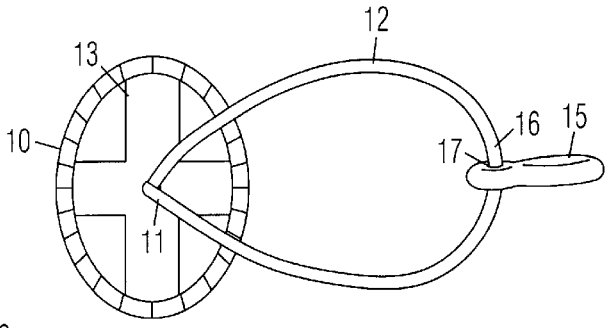
FIG. 3 is an end view thereof.

FIGS. 1–3:

A preferred embodiment of the present hair roller is shown in a perspective view in FIG. 1, a side view in FIG. 2, and an end view in FIG. 3. It is comprised of a hollow tube 10 with an elliptical cross section for producing hair curls of a pleasing novel shape. The elliptical shape is smoothly curved all around, and is entirely without any straight lines or sharp corners. The hair roller is preferably provided in a variety of sizes for making curls of different sizes, wherein the size of the curl is directly proportional to the width of the roller's cross section.

A fixed end 11 of an elastic loop 12 is attached to an anchor member 13 inside tube 10 at a first end 14. Fixed end 11 of elastic loop 12 is preferably centered in tube 10, as shown in FIG. 3. In this example, anchor member 13 is a cross spanning the interior of tube 10, but it may be of another shape. A handle 15 is attached to a free end 16 of loop 12. Handle 15 is preferably provided with a hole 17 through which loop 12 is inserted, and is preferably loose enough to slide freely along loop 12.

A texture 18 is provided on the outside of tube 10 for traction to prevent hair from slipping. In this example, texture 18 is comprised of small bumps distributed generally throughout the entire surface of tube 10. For simplicity, only a few bumps are shown. Alternatively, texture 18 may be of another type of irregular or rough surface. Holes 19 are distributed around the outside of tube 10 to help perm solution to soak through the hair for a permanent wave, and to enable air circulation for drying the hair faster for a wet set or temporary wave. In this example, holes 19 are comprised of wavy slits. Alternatively, holes of another shape may be provided.

Figure 4:
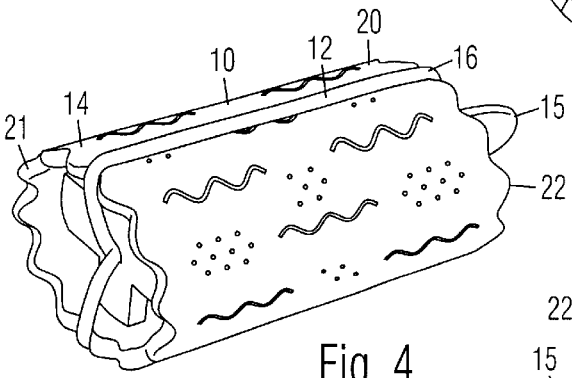
FIG. 4 is a perspective view from a first end of the roller when an elastic loop is stretched across a second end.
Figure 5:
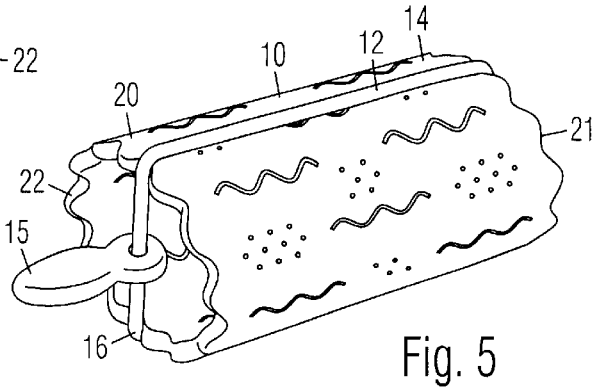
FIG. 5 is a perspective view from the second end of the roller when the elastic loop is stretched across the second end.

FIGS. 4–5:

After hair (not shown) is wrapped around tube 10, loop 12 is stretched across the width of tube 10 and free end 16 is stretched across a second end 20 of tube 10 to secure the hair, as shown in FIGS. 4–5. Loop 12 can be easily manipulated by grabbing handle 15. The hair is secured by loop 12 on two sides of tube 10 and is thus positively prevented from loosening, which is particularly advantageous for a wet set.

The opposite ends of tube 10 have scalloped edges 21 and 22 that stabilize loop 12 in its selected radial positions. Scalloped edges 21 and 22 may be sinusoidal as shown, or they may be of another shape. In this example, loop 12 is shown stretched across the minor axis or lesser width of tube 10, so that the hair is anchored to one of the less curved sides of tube 10 for making curls of a particular shape. Alternatively, loop 12 can be stretched across the major axis or greater width of the tube 10, so that the hair is anchored to one of the more curved sides of tube 10 for making curls of a slightly different shape. Loop 12 can also be stretched across tube 10 in other radial positions for producing different curls.

SUMMARY AND SCOPE

Accordingly, the elliptical cross section of the present hair roller produces hair curls of a novel shape. The elastic loop secures the hair on two sides of the tube to prevent the hair from loosening. The elastic cord can be wrapped around the tube in different radial positions to change the attachment point of the hair on the roller for making curls of different shapes. The texture on the tube prevents the hair from slipping off. The holes help perm solution to soak into the hair and speed up drying. The roller is also very simple in construction.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A hair roller, comprising:

a hollow tube with an elliptical cross section which is smoothly curved all around, entirely without any straight lines, and without any sharp comers, wherein said tube is adapted for rolling hair;

first and second sinusoidal scalloped edges aligned with each other and arranged completely around a first end and a second end of said tube; and an elastic loop with a fixed end connected adjacent said first end of said tube;

wherein said fixed end of said loop is stretchable across a width of said tube at said first end of said tube, and a free end of said loop is stretchable across said width at said second end of said tube for securing said hair;

wherein said loop is stretchable across said width of said tube in different radial positions around said elliptical cross section for producing different curls;

wherein said loop is maintained in any selected radial position by said scalloped edges.

2. The hair roller of claim 1, further including a rough texture around said tube for preventing said hair from slipping.

3. The hair roller of claim 1, further including holes distributed around said tube for helping perm solution to soak through said hair for a permanent wave, and for enabling air circulation for drying said hair faster for a temporary wave.

4. The hair roller of claim 1, further including holes comprised of wavy slits distributed around said tube for helping perm solution to soak through said hair for a permanent wave, and for enabling air circulation for drying said hair faster for a temporary wave.

5. The hair roller of claim 1, further including a handle attached to said loop.

6. The hair roller of claim 1, further including an anchor member spanning an interior of said tube adjacent only at said first end of said tube, wherein said fixed end of said elastic loop is attached to said anchor member in alignment with a central axis of said tube.

7. A hair roller, comprising:

a hollow tube with an elliptical cross section which is smoothly curved all around, entirely without any straight lines, and without any sharp corners, wherein said tube is adapted for rolling hair;

first and second scalloped edges respectively at a first end and a second end of said tube;

an anchor member spanning across an interior of said tube adjacent only said first end of said tube; and an elastic loop with a fixed end secured in a hole on said anchor member along a central axis of said tube;

wherein said fixed end of said loop is stretchable across a width of said tube at said first end of said tube, and said free end of said loop is stretchable across said width at said second end of said tube for securing said hair;

wherein said loop is stretchable across said width of said tube in different radial positions around said elliptical cross section for producing different curls;

wherein said loop is maintained in any selected radial position by said scalloped edges.

* * * * *